US009494004B2

(12) United States Patent
Trinh et al.

(10) Patent No.: US 9,494,004 B2
(45) Date of Patent: Nov. 15, 2016

(54) ADJUSTABLE CORING ASSEMBLY AND METHOD OF USING SAME

(71) Applicant: National Oilwell Varco, L.P., Houston, TX (US)

(72) Inventors: Khoi Trinh, Spring, TX (US); Folarin Ozah, Houston, TX (US); Rick N. Mecham, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 452 days.

(21) Appl. No.: 14/136,856

(22) Filed: Dec. 20, 2013

(65) Prior Publication Data

US 2015/0176355 A1 Jun. 25, 2015

(51) Int. Cl.
*E21B 25/00* (2006.01)
*E21B 25/10* (2006.01)

(52) U.S. Cl.
CPC ..... *E21B 25/00* (2013.01); *E21B 25/10* (2013.01)

(58) Field of Classification Search
CPC ..... E21B 25/10; E21B 25/00
See application file for complete search history.

(56) References Cited

U.S. PATENT DOCUMENTS 2,907,589 A 10/1959 Knox
2,929,612 A * 3/1960 Le Bus, Sr. ..... E21B 25/00 175/239
3,451,263 A 6/1969 Richter, Jr. et al.
4,580,643 A * 4/1986 Fox ..... E21B 25/00 175/236
4,878,549 A 11/1989 Bennet
4,969,528 A 11/1990 Jurgens
5,303,743 A 4/1994 Vincent
6,006,844 A 12/1999 Puymbroeck et al.
2007/0261886 A1 11/2007 Wilson et al.
2013/0081878 A1 4/2013 Wilson
2013/0092442 A1 4/2013 Zastresek et al.
2014/0027182 A1* 1/2014 Wilson ..... E21B 10/02 175/58

OTHER PUBLICATIONS

"Coring Services", Halliburton, H0323, 2009, 20 pages.

* cited by examiner

*Primary Examiner* — Nicole Coy
(74) *Attorney, Agent, or Firm* — Conley Rose, P.C.

(57) ABSTRACT

A coring extender for a coring tool is provided. The coring tool is deployable by a downhole tool into a wellbore. The coring extender includes a housing operatively connectable to the downhole tool, a mandrel, and seals. The housing has fluid chambers therein. The mandrel is positionable in the housing, and includes a locking tube operatively connectable to the housing and a coupling tube operatively connectable to the coring tool. The coupling tube is adjustably positionable relative to the locking tube such that a length of the mandrel is adjustably defined therebetween. The coupling tube has an outer surface slidably positionable along an inner surface of the housing. Seals are positionable between the mandrel and the housing to define a fluid pocket to isolate the fluid therebetween as the coupling tube moves along the housing whereby the fluid permitted to flow about the fluid pocket to balance between the fluid chambers.

23 Claims, 7 Drawing Sheets

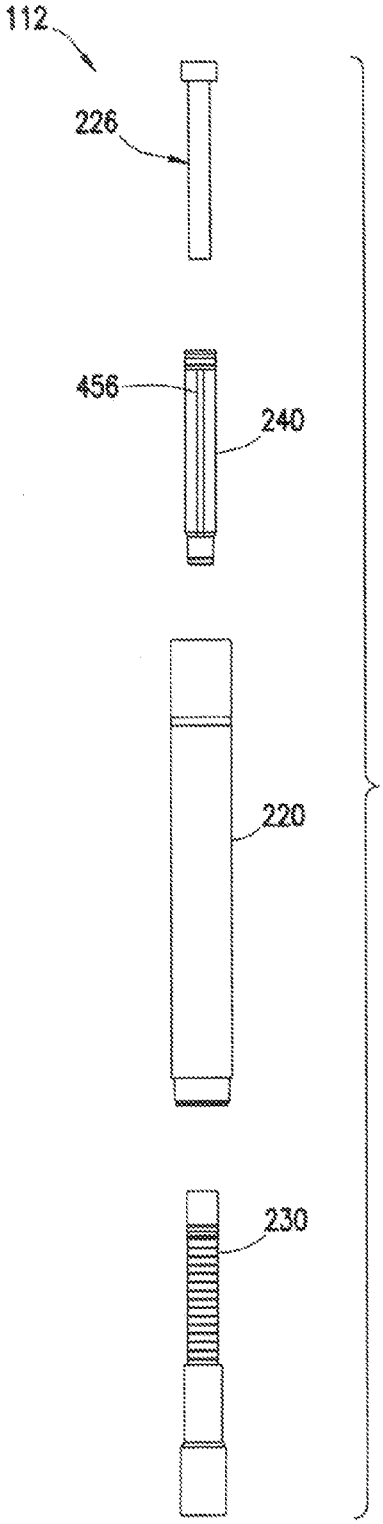
FIG. 4A
FIG. 4B
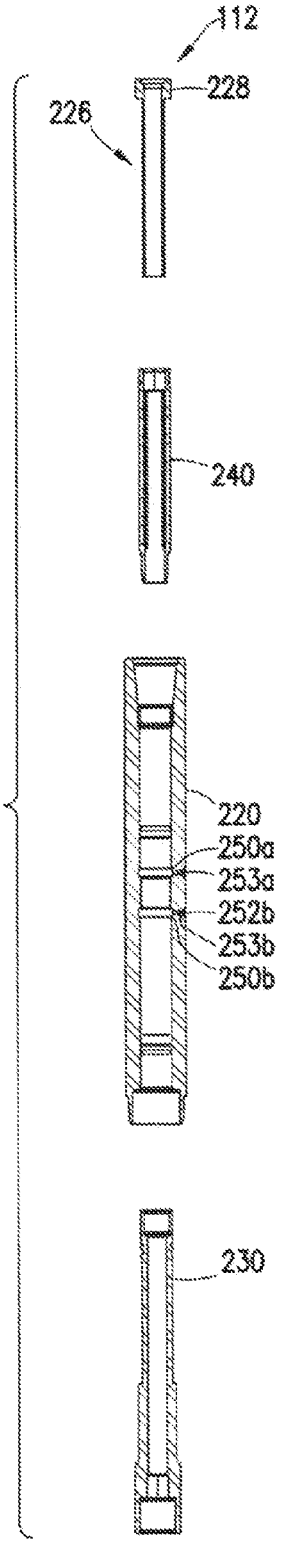

ADJUSTABLE CORING ASSEMBLY AND METHOD OF USING SAME

BACKGROUND

The present disclosure relates generally to techniques for performing wellsite operations. More specifically, the present disclosure relates to sampling techniques, such as coring tools, use for obtaining downhole samples.

Oilfield operations may be performed to locate and gather valuable downhole fluids. Oil rigs are positioned at wellsites, and downhole equipment, such as a drilling tool, is deployed into the ground by a drill string to reach subsurface reservoirs. At the surface, an oil rig is provided to deploy stands of pipe into the wellbore to form the drill string.

Various surface equipment, such as a top drive, a Kelly, and a rotating table, may be used to apply torque to the stands of pipe, to threadedly connect the stands of pipe together, and to rotate the drill string. A drill bit is mounted on a lower end of the drill string, and advanced into the earth by the surface equipment to form a wellbore. The drill string may be provided with various downhole components, such as a bottom hole assembly (BHA), drilling motor, measurement while drilling, logging while drilling, telemetry, reaming and other downhole tools, to perform various downhole operations.

The downhole tool may be provided with devices for obtaining downhole samples, such as core samples. Examples of downhole devices are provided in US Patent/Application Nos. 2013/0081878 and 2013/0092442, the entire contents of which are hereby incorporate by reference herein.

SUMMARY

In at least one aspect, the disclosure relates to a coring extender for a coring tool for obtaining a core sample of a subterranean formation. The coring tool is deployable by a downhole tool into a wellbore penetrating the subterranean formation, and has a core cavity to receive the core sample. The coring extender includes a housing operatively connectable to the downhole tool, a mandrel positionable in the housing, and seals. The housing has a plurality of fluid chambers therein. The mandrel comprising a locking tube operatively connectable to the housing and a coupling tube operatively connectable to the coring tool. The locking tube is operatively connectable to the coupling tube and adjustably positionable relative thereto such that a length of the mandrel is adjustably defined therebetween. The coupling tube has an outer surface slidably positionable along an inner surface of the housing. The seals are positionable between the mandrel and the housing to define a fluid pocket to isolate the fluid therebetween as the coupling tube moves along the housing whereby the fluid permitted to flow about the fluid pocket to balance between the fluid chambers.

The coupling tube may include a coupling portion operatively connectable to the coring tool and a fluid portion movably engageable with the locking tube. The locking tube may include a lock engageable with the housing. The lock may define a stop to terminate travel of the coupling tube. The coupling tube may have threads about the outer surface thereof. The threads may be threadedly engageable with the housing to adjustably position the coupling tube about the housing. The threads may be positioned in the fluid pocket between the fluid chambers. The coupling tube may have a channel extending into an outer surface thereof, the channel positionable about the fluid chambers to permit flow therebetween.

The downhole coring tool may also include a wear ring positionable between the mandrel and the housing. The housing may have ports therethrough, the ports in fluid communication with the fluid chambers. The downhole coring tool may also include plugs positionable in the ports. The fluid may include oil. The mandrel may have ports and a passage therein for the passage of fluid therethrough and a seat for receiving a ball.

In at least one aspect, the disclosure relates to a coring assembly for obtaining a core sample of a subterranean formation. The coring assembly is deployable into a wellbore penetrating the subterranean formation. The coring assembly includes a coring tool carried by a downhole tool and having a coring cavity to receive the to the core sample and a coring extender carried by the downhole tool. The coring extender includes a housing operatively connectable to the downhole tool, a mandrel positionable in the housing, and seals. The housing has a plurality of fluid chambers therein. The mandrel comprising a locking tube operatively connectable to the housing and a coupling tube operatively connectable to the coring tool. The locking tube is operatively connectable to the coupling tube and adjustably positionable relative thereto such that a length of the mandrel is adjustably defined therebetween. The coupling tube has an outer surface slidably positionable along an inner surface of the housing. The seals are positionable between the mandrel and the housing to define a fluid pocket to isolate the fluid therebetween as the coupling tube moves along the housing whereby the fluid permitted to flow about the fluid pocket to balance between the fluid chambers.

The downhole tool may be a drilling tool having a bit at a downhole end thereof, the coring tool receivable in the bit. The downhole coring system may also include a wrench operatively connectable to the coring extender to selectively adjust the mandrel, and/or a ball deployable into a passage of the mandrel and seatable therein. The mandrel may have ports therein for the passage of fluid therethrough.

Finally, in another aspect, the disclosure relates to a method of obtaining a core sample of a subterranean formation. The method involves deploying a coring assembly into the wellbore via a downhole tool. The coring assembly includes a coring tool having a coring cavity to receive the to the core sample and a coring extender operatively connectable to the coring tool. The coring extender includes a housing and a mandrel. The mandrel includes a locking tube and a coupling tube. The housing has a plurality of fluid chambers therein. The method may also involve adjusting a length of the mandrel in the housing by slidably positioning the coupling tube along the locking tube, sealing a fluid in a pocket between the coupling tube and the housing, permitting the fluid to flow in the pocket and to balance between the fluid chambers as the coupling tube moves along the housing, and receiving a coring sample into the core cavity.

The adjusting may be performed by applying torque to the coring assembly using a wrench and/or by moving the coupling tube along the housing via threads therebetween. The method may also involve passing fluid into and out of the fluid chambers via ports in the housing. The adjusting may be performed repeatedly without requiring removal of the fluid. The method may also involve selectively diverting fluid flow about the coring assembly. The deploying may involve deploying the coring assembly via a downhole drilling tool, and the method may also involve drilling the wellbore with the downhole drilling tool.

BRIEF DESCRIPTION OF THE DRAWINGS

A more particular description of the disclosure may be had by reference to embodiments thereof that are illustrated in the appended drawings. It is to be noted, however, that the appended drawings illustrate are not to be considered limiting of its scope. The figures are not necessarily to scale and certain features, and certain views of the figures may be shown exaggerated in scale or in schematic in the interest of clarity and conciseness.

FIGS. 4A and 4B are exploded perspective and cross-sectional views, respectively, of the coring assembly of FIG. 3A.

DETAILED DESCRIPTION OF THE INVENTION

The description that follows includes exemplary apparatus, methods, techniques, and/or instruction sequences that embody aspects of the present subject matter. However, it is understood that the described embodiments may be practiced without these specific details.

The present disclosure relates to an adjustable coring assembly for collecting downhole core samples. The coring assembly includes a coring extender coupled to a coring tool. The coring assembly is positionable in a downhole tool, such as a downhole drilling tool, and deployable into the wellbore to receive core samples of a subsurface formation. The coring extender includes a housing connectable to the downhole tool and a mandrel comprising a locking tube connectable to the housing, and a coupling tube connectable to the coring tool. The coupling tube is adjustably positionable relative to the locking tube, to selectively adjust a length of the coring extender.

The coupling tube may be threadedly connected to the housing and axially movable therein by rotation thereof. A wrench may be provided to rotate the mandrel, and to extend and/or retract the coupling tube about the housing. The length of the coring assembly may be varied, for example, to adjust for tolerances of the various components (e.g., tubes) of the coring assembly and/or to adjust for length variation of the coring assembly. Length variation may result, for example, from thermal expansion and/or tolerances of components of the drilling and/or coring assembly.

The coupling tube may have a pocket about an outer surface thereof positionable about a pair of fluid chambers in the housing to selectively shift fluid and adjust a volume to balance fluid therebetween as the coupling tube is adjustably positioned about the housing. The pocket and chambers may be used to provide a self-contained fluid (e.g., hydraulic and/or lubrication) system that does not require services at the rig floor, and that may be re-used multiple times (e.g., until it reaches its maintenance cycle).

Figure 1A:
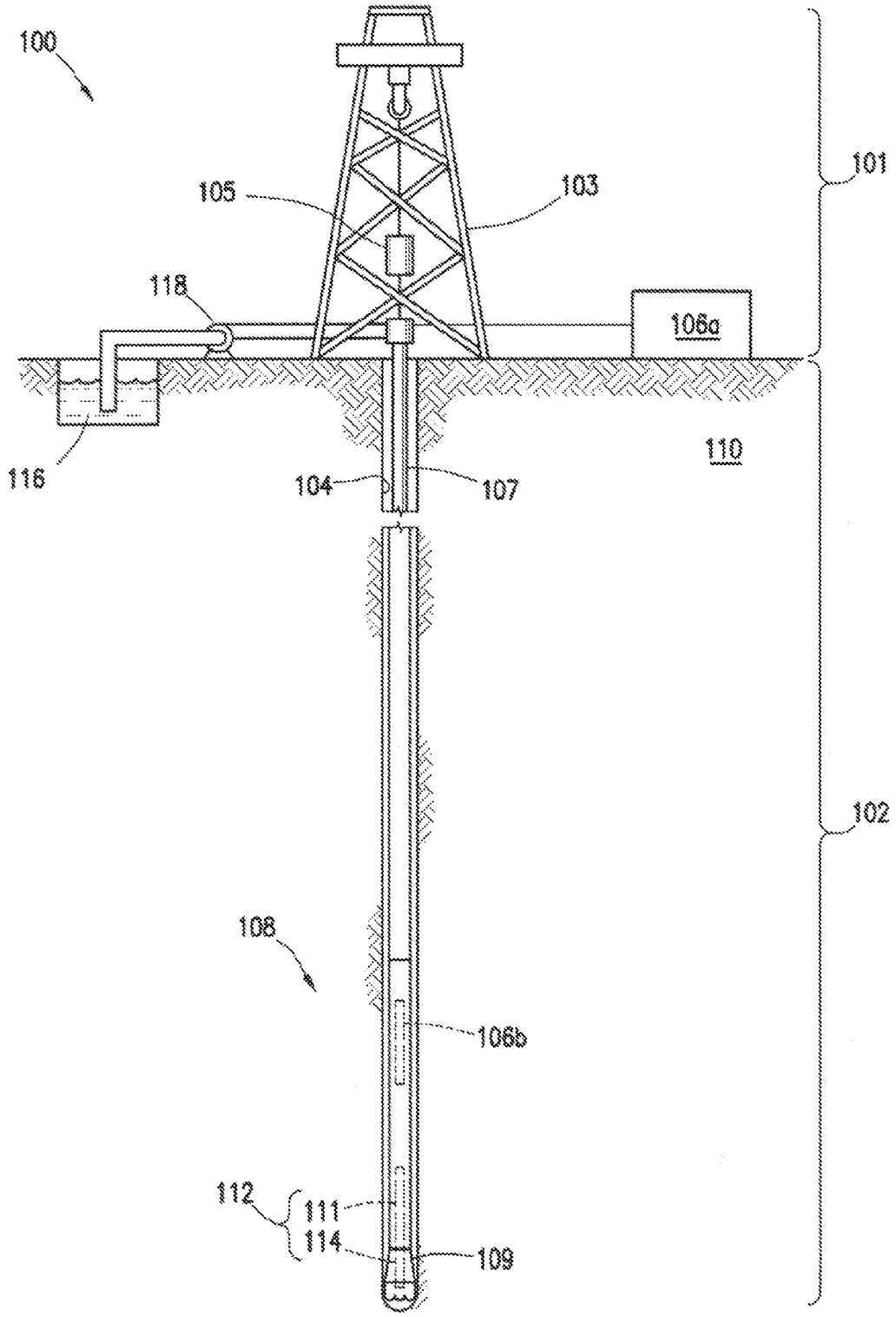
FIGS. 1A and 1B depict schematic views, partially in cross-section of a wellsite having surface equipment and downhole equipment, the downhole equipment including a downhole drilling tool with an adjustable coring assembly.
Figure 1B:
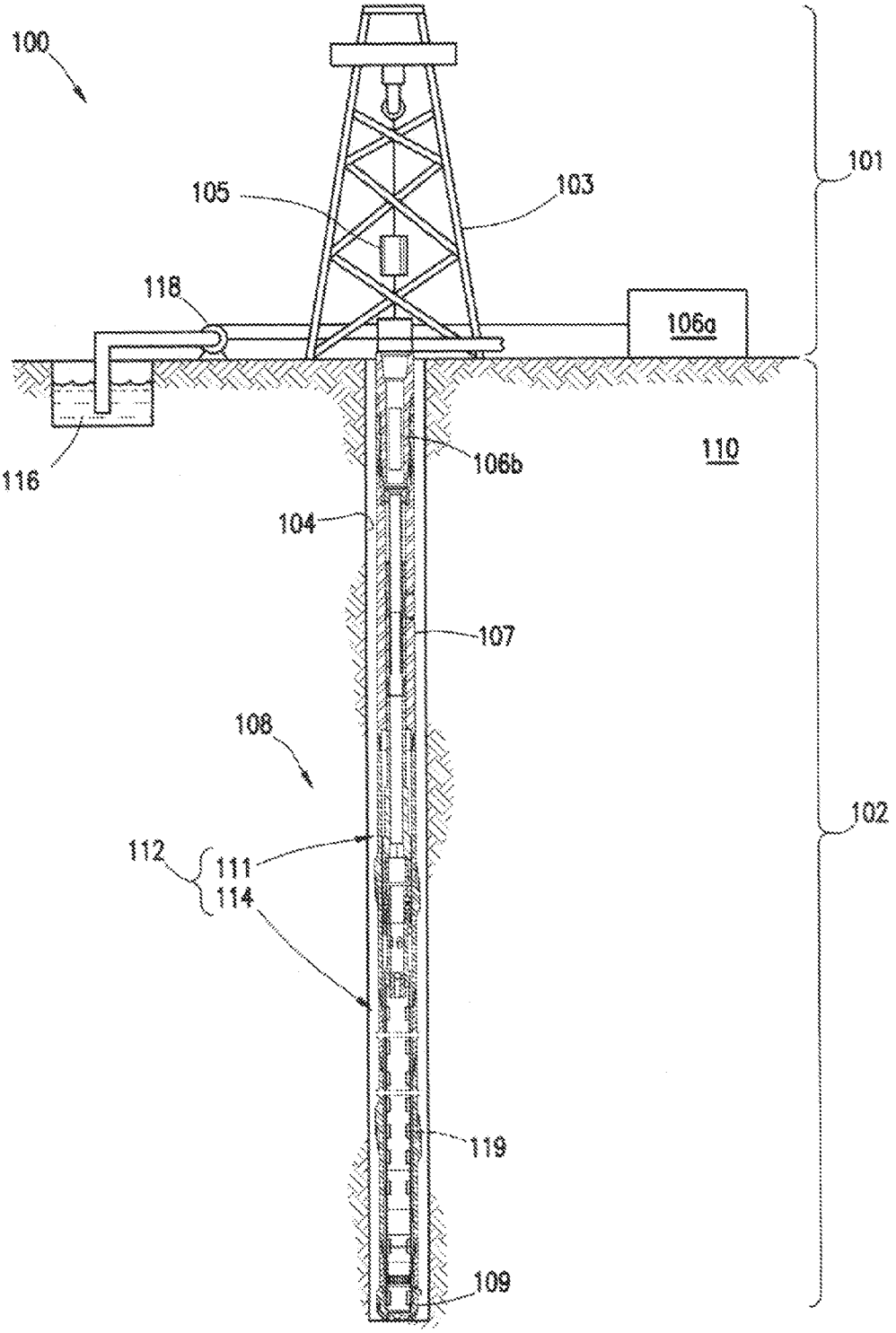

FIGS. 1A and 1B depict various schematic views, partially in cross-section, of a wellsite 100. While a land-based drilling rig with a specific configuration is depicted, the present disclosure may involve a variety of land based or offshore applications. The wellsite 100 includes surface equipment 101 and downhole equipment 102. FIG. 1A shows the downhole equipment 102 advanced into the formation 110 to form the wellbore 104. FIG. 1B shows the downhole equipment 102 during assembly.

The surface equipment 101 includes a rig 103 positionable at a wellbore 104 for performing various wellbore operations, such as drilling. The surface equipment 101 may include various rig equipment 105, such as a Kelly, rotary table, top drive, elevator, etc., provided at the rig 103 to operate the downhole equipment 102. A surface controller 106*a* is also provided at the surface to operate the drilling equipment. While drilling equipment is depicted, the surface equipment 101 and downhole equipment 102 may be used with drilling, wireline, production, stimulation, completion and/or other equipment.

The downhole equipment 102 includes a drill string 107 with a bottom hole assembly (BHA) 108 and a drill bit 109 at an end thereof. The downhole equipment 102 is advanced into a subterranean formation 110 to form the wellbore 104. The drill string 107 may include drill pipe, drill collars, coiled tubing or other tubing used in drilling operations. Downhole equipment, such as the BHA 108, is deployed from the surface and into the wellbore 104 by the drill string 107 to perform downhole operations.

The BHA 108 is at a lower end of the drill string 107 and contains various downhole equipment for performing downhole operations. As shown, the BHA 108 includes a coring assembly 112 and a downhole controller 106*b*. The downhole controller 106*b* provides communication between the BHA 108 and the surface controller 106*a* for the passage of power, data and/or other signals. One or more controllers 106*a,b* may be provided about the wellsite 100. The BHA 108 may also include various other downhole components, such as stabilizers, reamers, a measurement while drilling tool, a logging while drilling tool, a telemetry unit, and/or other downhole components.

A mud pit 116 may be provided as part of the surface equipment 101 for passing mud from the surface equipment 101 and through the downhole equipment 102, the BHA 108 and the bit 109 as indicated by the arrows. Various flow devices, such as pump 118 may be used to manipulate the flow of mud about the wellsite 100. Various tools in the BHA 108, such as the coring assembly 112, may be activated by fluid flow from the mud pit 116 and through the drill string 107.

The coring assembly 112 may include a coring tool 114 for receiving a core sample from the formation 110 about the wellbore 104. The coring tool 114 as shown may be an axial coring tool positioned in the bit 109 to receive a core sample as the bit 109 is advanced into the formation 110. A core sample 119 may be extracted from reservoir rocks and retrieved at the surface for evaluation and/or analysis, for example, to support production planning.

The coring assembly 112 is also provided with a coring extender 111 operatively connectable to the coring tool 114 for selectively adjusting a length of the coring assembly 112. As shown in FIG. 1B, part of the BHA 108 with the coring assembly 112 is deployed into the wellbore 104 during make up. A wrench may be provided at the surface to activate and/or adjust the coring assembly 112. The coring assembly 112 may be adjusted, for example, based on stack-up tolerances, length variation of coring tools, formation conditions, downhole operations, etc. The wrench may be removed and the remaining portions of the downhole equipment 102 may be assembled to perform downhole operations, such as drilling and/or coring.

Figure 2:
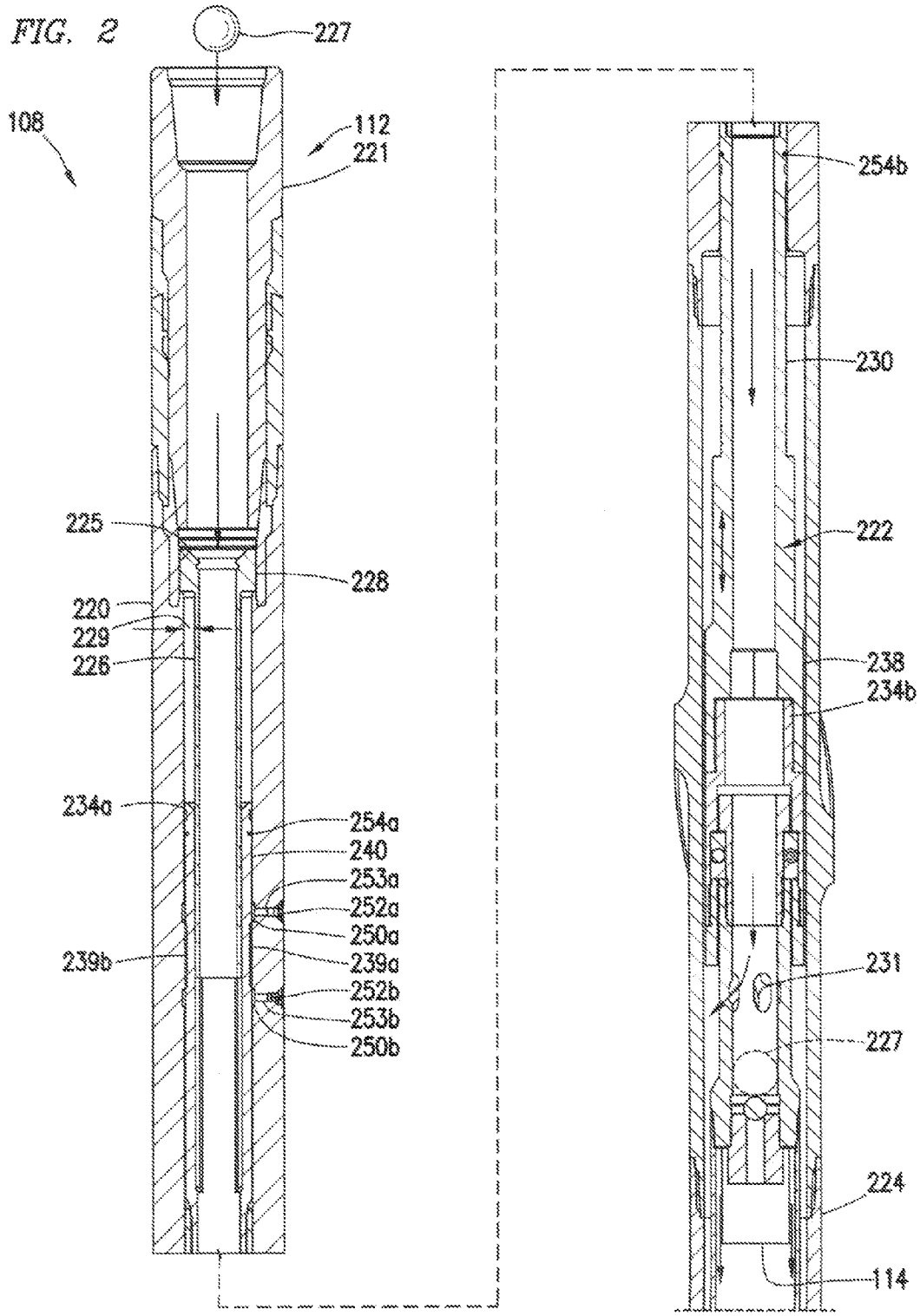
FIG. 2 is a longitudinal cross-sectional view of a portion of the downhole tool of FIG. 1B having the adjustable coring assembly therein.
Figure 3A:
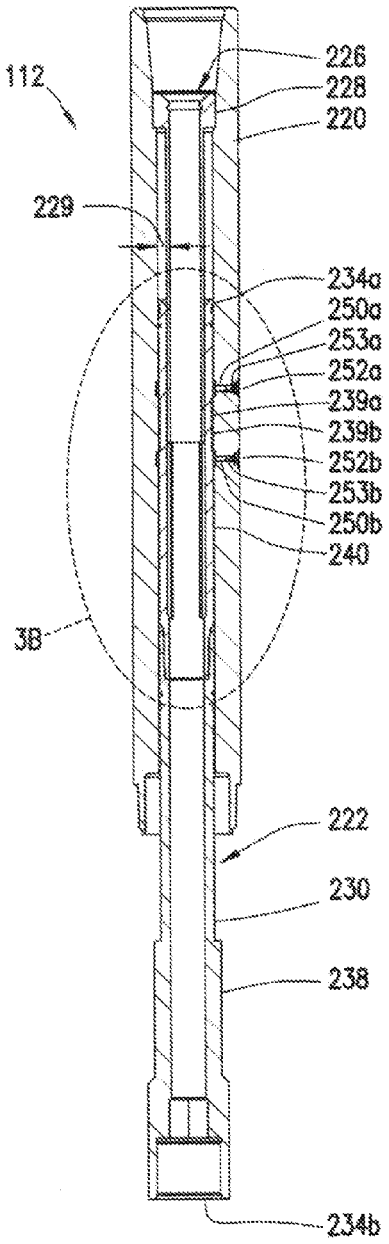
FIG. 3A is longitudinal cross-sectional view of the adjustable coring assembly of FIG. 2.
Figure 3B:
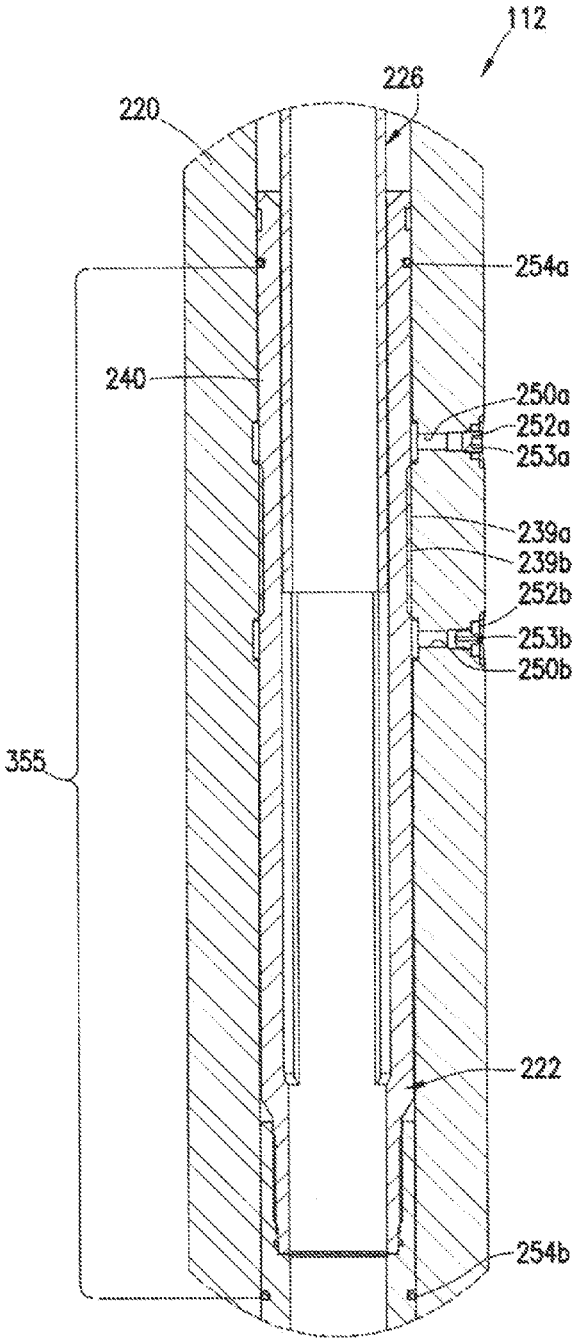
FIG. 3B is a portion 3B of the adjustable coring assembly of FIG. 3A.
Figure 5A:
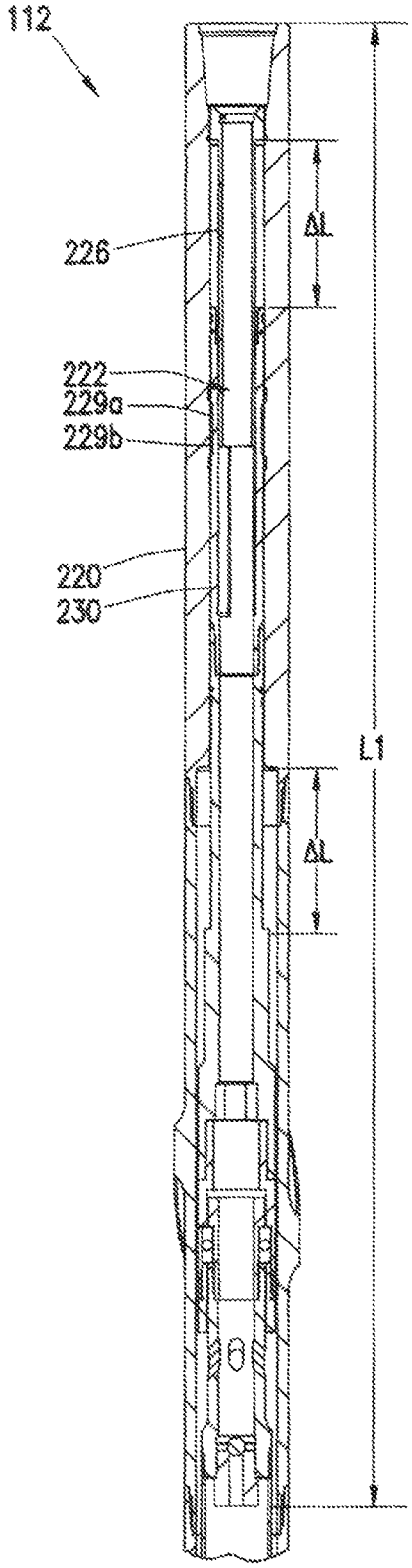
FIGS. 5A and 5B are longitudinal cross-sectional views of the adjustable coring assembly of FIG. 2 in an extended and a retracted position, respectively.
Figure 5B:
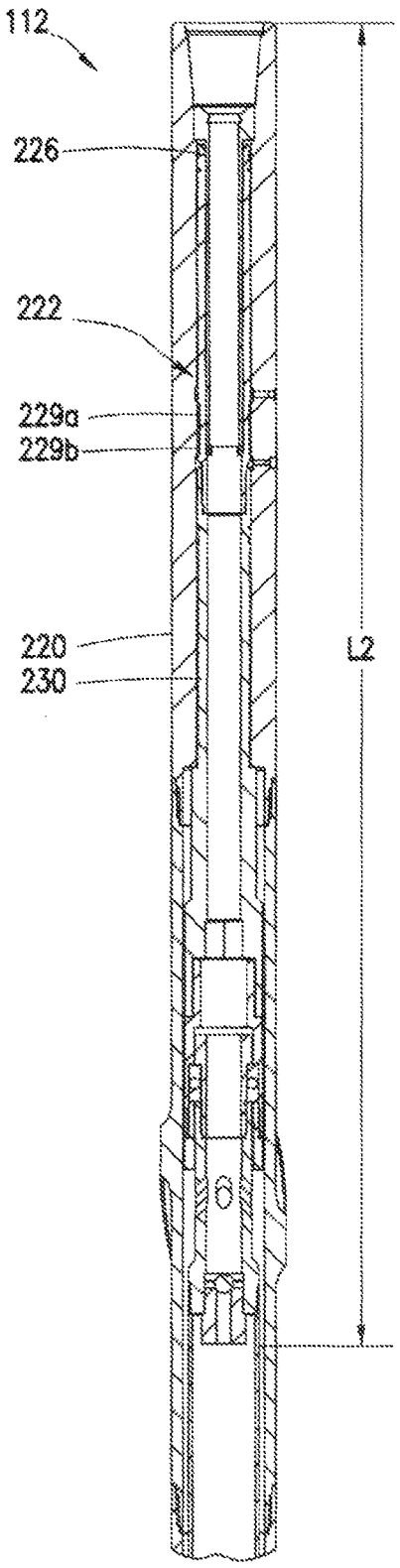

FIG. 2 depicts a portion of the BHA 108 depicting the coring assembly 112 of FIG. 1B therein. FIGS. 3A-5B show various views of the coring assembly 112. FIG. 3A shows the coring assembly 112 removed from the BHA 108. FIG. 3B shows a portion 3B of the coring assembly 112 of FIG. 3A in greater detail. FIGS. 4A and 4B show perspective and cross-sectional views, respectively, of the coring assembly 112. FIGS. 5A and 5B shows the coring assembly 112 in an extended and retracted position, respectively.

Referring first to FIG. 2, the coring assembly 112 is positioned in the BHA 108. The coring assembly 112 includes a housing 220 and a mandrel 222 operatively connectable to the coring tool 114. The housing 220 may include, for example, one or more drill collars or other tubing operatively connectable to and/or positionable in the BHA 108. As shown, the housing 220 is also operatively connectable between a top sub 221 of the BHA 108 and a stabilizer sub/swivel assembly 224. The housing 220 may have various shoulders or steps along the inner surface for engaging an outer surface of the mandrel 222. The coring tool 114 is positioned downhole from the sub swivel assembly 224 (see, e.g., FIG. 1B).

Referring to FIGS. 1B and 2, the coring assembly 112 has an inner surface defining a mud passage 225 therethrough. The mud passage 225 is in fluid communication with a passage of the BHA 108 and the drill string 107 to pass fluid therethough. Portions of the coring assembly 112, such as the housing 220, the mandrel 222 and other components may be positioned in the mud passage 225 and have individual passages therethrough in fluid communication with the mud passage 225.

As shown by the arrows, mud from mud pit 116 may pass through the mud passage 225, through the mandrel 222 and out the swivel assembly 224. Mud flow through the coring assembly 112 may be selectively adjusted, for example, by passing a ball 227 into the coring assembly 112. The ball 227 will pass through the mandrel 222 and seat about the swivel assembly 224 as indicated by the dashed circle.

Flow through the coring assembly 112 may then be diverted out ports 231 and into a space between the swivel assembly 224 and the housing 220 as indicated by the arrows. Mud flow may be selectively controlled to alter the mud passage. For example, during tripping (e.g., in tripping in mode), the mud may freely pass through the coring assembly 112 to cleanout downhole debris. In another example, during coring (e.g., during a coring operation), mud may diverted by deploying ball 227 such that the fluid passes around the coring tool 114 and allows a core sample 119 to enter the coring tool 114 without being washed out.

Referring to FIGS. 2, and 3A-4B, the mandrel 222 is positioned in housing 220. The mandrel includes a locking tube 226 fixedly positioned in the housing 220 and a coupling tube 230 movable relative to the locking tube 226. The locking tube 226 includes a lock 228 fixed near an uphole end of the housing 220. The locking tube 226 has a diameter smaller than a diameter of the lock 228 and an inner diameter of the housing 220 to provide a gap 229 therebetween. The lock 228 may be positioned along an inner surface of the housing 220 to secure the locking tube 226 in place within the housing 220.

The coupling tube 230 has an open uphole end 234*a* to receive the locking tube 226. The coupling tube 230 is adjustably (axially) positionable in the gap 229 between the locking tube 226 and the housing 220 as indicated by the arrows. The coupling tube 230 has the uphole end 234*a* engageable with the lock 228 to terminate uphole movement thereof. The coupling tube 230 extends a distance downhole from the locking tube 226 and the housing 220 for operative connection with the coring tool 114. The coupling tube 230 includes a coupling 238 and a fluid portion 240 threadedly connected together. The coupling 238 has a downhole end 234*b* operatively connectable to the coring tool 114.

The coupling tube 230 (e.g., the fluid portion 240) may be provided with threads 239*a* on an outer surface thereof for adjustably positioning the coupling tube 230 along the housing 220. The threads 239*a* may threadedly engage corresponding threads 239*b* along the housing 220. The coupling tube 230 may be advance along the threads 239*a,b* to selectively position the fluid portion 240 along the housing 220. For example, the coupling tube 230 may rotate clockwise to advance toward the coring tool 114, and rotate counterclockwise to retract toward the top sub 221.

FIGS. 5A and 5B show adjustment of the mandrel 222 to define an adjustable length of the coring assembly 112. FIG. 5A shows the coring assembly 112 in an extended position. FIG. 5B shows the coring assembly 112 in a retracted position. The length may be selectively adjusted by adjustably positioning the coupling tube 230 along the housing 220 and relative to the locking tube 226. The coupling tube 230 may be adjusted, for example, by rotating the coupling tube 230 along threads 229*a,b* using the wrench previously described.

The mandrel 222 has a length L1 in the extended position of FIG. 5A and a length L2 in the retracted position of FIG. 5B. The mandrel 222 has an adjustable length of $\Delta L$ defined by the amount of travel between the locking tube 226 and the coupling tube 230 to vary the length between L1 and L2.

Referring back to FIGS. 2-4B, the housing 220 has fluid chambers 250*a,b* therein for receiving fluid and ports 252*a,b* extending therein for the passage of fluid therethrough. The ports 252*a,b* may be used, for example, to pass the fluid into and/or out of the fluid chambers 250*a,b*. The fluid portion 240 may be positionable about the housing 220 to selectively permit fluid to flow between the fluid chambers 250*a,b*. Plugs (e.g., oil plug, fitting) 253*a,b* may be positioned in the fluid ports 252*a,b* to provide access to the fluid chambers 250*a,b*.

As shown in greater detail in FIG. 3B, a self-contained lubrication system is provided. As the fluid portion 240 is moved along the inner surface of the housing 220, fluid is permitted to pass between the fluid chambers 250*a,b*. The outer surface of the fluid portion 240 interacts with the housing 220 to selectively pass fluid therebetween. Fluid may pass between an outer surface of the fluid portion 240 and an inner surface of the housing 220, for example, to provide lubrication therebetween. Seals 254*a,b* may be provided about the fluid portion 240 to isolate the fluid therebetween. The seals 254*a,b* enclose a fluid pocket 355 between the fluid portion 240 and the housing 220.

The threads 239*a,b* are positioned along the fluid portion 240 and the housing 220 between the seals 254*a,b*. The threads 239*a,b* are protected from the downhole environment. The threads 229*a,b* may be isolated from, for example, mud in the BHA 108 by the seals 254*a,b* on either side thereof. In this environment, the threads 239*a,b* are isolated, sealed and filled with oil. The fluid chambers 250*a,b* on each side of the threads 239*a,b* may be provided with equal volumes of fluid.

As shown in FIGS. 3A-4B, a channel 456 is cut in the fluid portion 240 to allow fluid to communicate between the fluid chambers 250*a,b*. Fluid communicates via the channel 456 to both fluid chambers 250*a,b*. The fluid chambers 250*a,b* are disposed on opposite sides of the threads 239*a,b* and are filled with fluid to displace air and/or to avoid air pressure build up from hydrostatic pressure. As the system advances or retracts, fluid flows between the fluid chambers 250*a,b* to compensate for volume differences. As the coupling tube 240 advances or retracts along the housing 220, fluid migrates between the fluid chambers 250*a,b* to compensate for volume changes, and/or fluid in the pocket 355 may be displaced between the fluid chambers 250*a,b*.

The fluid may be maintained in the pocket 355 and fluid chamber 250*a,b* to provide a closed loop oil and/or lubrication system that maintains fluid where needed without requiring servicing between each adjustment of the coring assembly 112. This closed loop configuration may be used, for example, to prevent dumping of fluid downhole and/or to maintain fluid in the system for repeated usage.

Figure 6:
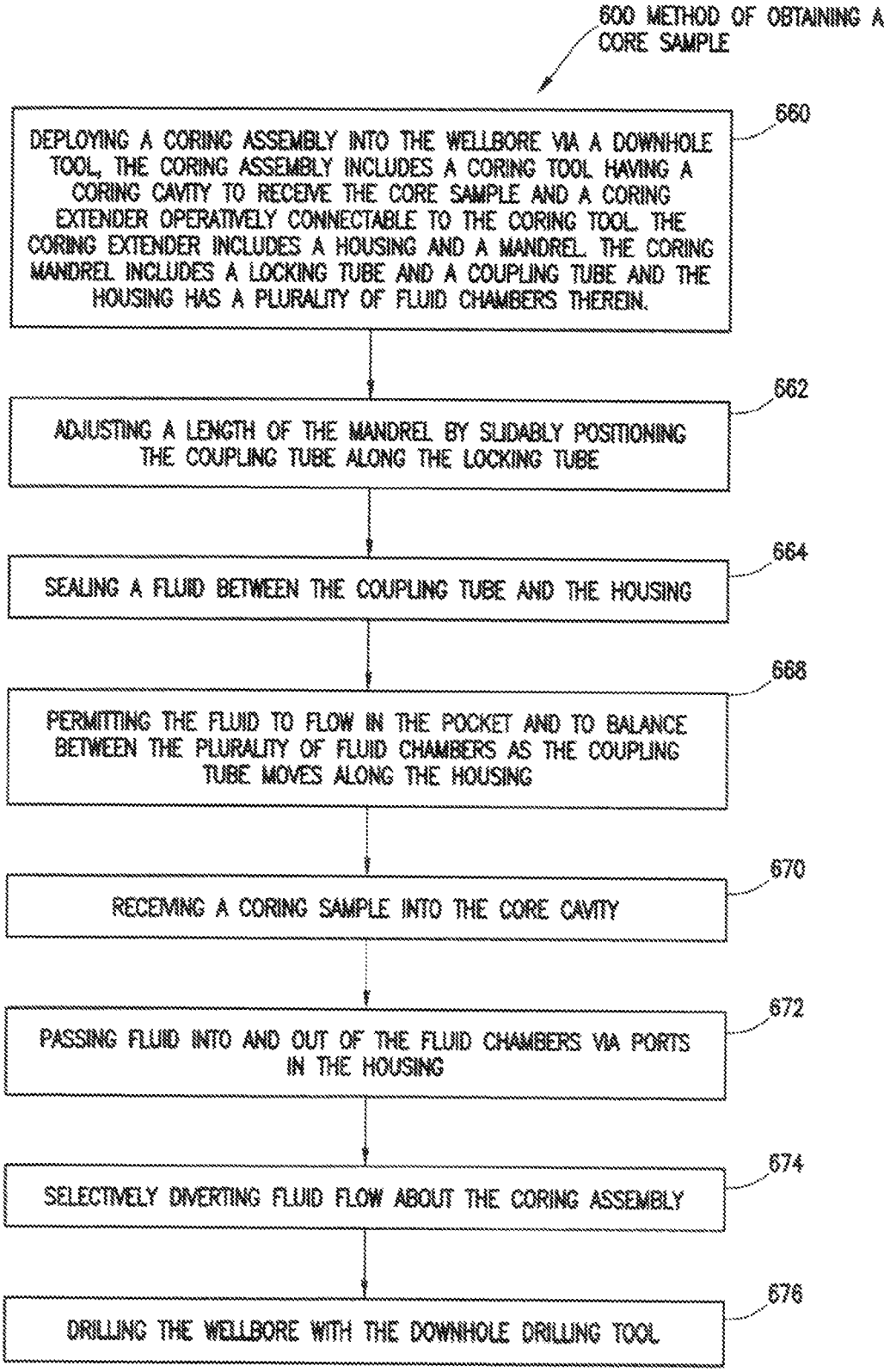
FIG. 6 is a flow chart depicting a method of obtaining a core sample.

FIG. 6 is a flow depicting a method 600 of obtaining a core sample of a subterranean formation. The method involves 660—deploying a coring assembly into the wellbore via a downhole tool. The coring assembly includes a coring tool having a coring cavity to receive the core sample and a coring extender operatively connectable to the coring tool. The coring extender includes a housing and a mandrel. The mandrel includes a locking tube and a coupling tube and the housing has a plurality of fluid chambers therein.

The method also involves 662—adjusting a length of the mandrel by slidably positioning the coupling tube along the locking tube, 664—sealing a fluid between the coupling tube and the housing, 668—permitting the fluid to flow in the pocket and to balance between the plurality of fluid chambers as the coupling tube moves along the housing, 670—receiving a coring sample into the core cavity.

The method may also involve 672—passing fluid into and out of the fluid chambers via ports in the housing, 674—selectively diverting fluid flow about the coring assembly, and/or 676—drilling the wellbore with the downhole drilling tool. The method may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, the coring extender maybe provided with one or more portions of the housing, mandrel, locking tube, lock, coupling tube, fluid portion, coupling, seals, and/or other devices. While features of the systems, assemblies and tools are shown in a specific orientation (e.g., uphole/downhole), it will be appreciated that the orientation may optionally be inverted for use in an uphole or a downhole orientation.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A coring extender for a coring tool for obtaining a core sample of a subterranean formation, the coring extender comprising:

a housing having a longitudinal axis and including a first fluid chamber and a second fluid chamber axially spaced from the first fluid chamber;

a mandrel disposed in the housing, the mandrel comprising a locking tube operatively connectable to the housing and a coupling tube configured to be coupled to the coring tool, the locking tube operatively connectable to the coupling tube and adjustably positionable relative thereto such that a length of the mandrel is adjustably defined therebetween, the coupling tube having an outer surface slidably positionable along an inner surface of the housing; and a first seal positioned between the mandrel and the housing and a second seal positioned between the mandrel an the housing, wherein the second seal is axially spaced from the first seal, wherein the first fluid chamber and the second fluid chamber are axially positioned between the first seal and the second seal;

wherein the first seal and the second seal define a fluid pocket between the housing and the mandrel to isolate a lubricating fluid therebetween as the coupling tube moves along the housing, wherein the fluid pocket is configured to permit the lubricating fluid to flow between the first fluid chamber and the second fluid chamber to lubricate engaged mating threads axially positioned between the first chamber and the second chamber.

2. The coring extender of claim 1, wherein the coupling tube comprises a coupling portion configured to be coupled to the coring tool and a fluid portion movably engageable with the locking tube.

3. The coring extender of claim 1, wherein the locking tube comprises a lock engageable with the housing, the lock defining a stop to terminate travel of the coupling tube.

4. The coring extender of claim 1, wherein the coupling tube has a channel extending along the outer surface thereof, wherein the channel extends between the first fluid chamber and the second fluid chamber to permit flow of the lubricating fluid therebetween.

5. The coring extender of claim 1, further comprising a wear ring positionable between the mandrel and the housing.

6. The coring extender of claim 1, wherein the housing has a first port in fluid communication with the first fluid chamber and a second port in fluid communication with the second fluid chamber.

7. The coring extender of claim 6, further comprising a first plug disposed in the first port and a second plug disposed in the second port.

8. The coring extender of claim 1, wherein the mandrel has ports and a passage therein for the passage of a fluid therethrough and a seat for receiving a ball.

9. The coring extender of claim 1, wherein the engaged mating threads axially positioned between the first chamber and the second chamber comprise threads on the outer surface of the coupling tube that threadedly engage mating threads on the inner surface of the housing.

10. The coring extender of claim 9, wherein the engaged mating threads on the outer surface of the coupling tube and on the inner surface of the housing are configured to allow the coupling tube to move axially relative to the locking tube and the housing.

11. The coring extender of claim 1, wherein the first seal sealingly engages the coupling tube and the mandrel, and wherein the second seal sealingly engages the coupling tube and the mandrel.

12. A coring assembly for obtaining a core sample of a subterranean formation, the coring assembly deployable into a wellbore penetrating the subterranean formation, the coring assembly comprising:

a coring extender comprising:

a housing having a plurality of fluid chambers therein;

a mandrel positionable in the housing, the mandrel comprising a locking tube operatively connectable to the housing and a coupling tube configured to couple to a coring tool, the locking tube operatively connectable to the coupling tube and adjustably positionable relative thereto such that a length of the mandrel is adjustably defined therebetween, the coupling tube having an outer surface slidably positionable along an inner surface of the housing;

a first seal positioned between and sealingly engaging the coupling tube and the housing; and a second seal positioned between and sealingly engaging the coupling tube and the housing, wherein the first seal and the second seal define a fluid pocket to isolate the fluid therebetween as the coupling tube moves along the housing whereby the fluid permitted to flow about the fluid pocket to balance between the fluid chambers.

13. The coring assembly of claim 12, further comprising a ball deployable into a passage of the mandrel and seatable therein.

14. The coring assembly of claim 13, wherein the mandrel has ports therein for the passage of fluid therethrough.

15. The coring assembly of claim 12, wherein the coupling tube has threads on the outer surface of the coupling tube that threadedly engage and mate with threads on the inner surface of the housing, wherein threads of the coupling tube and the threads of the housing engage between the first seal and the second seal.

16. The coring assembly of claim 15, wherein the fluid in the fluid pocket is configured to lubricate the threads of the coupling tube and the threads of the housing.

17. A method of obtaining a core sample of a subterranean formation, the method comprising:

deploying a coring assembly into the wellbore via a downhole tool, the coring assembly comprising a coring tool having a coring cavity to receive the core sample and a coring extender operatively connectable to the coring tool, the coring extender comprising a housing and a mandrel, the mandrel comprising a locking tube and a coupling tube, the housing having a plurality of fluid chambers therein;

adjusting a length of the mandrel in the housing by slidably positioning the coupling tube along the locking tube;

sealing a lubricating fluid in a pocket between the coupling tube and the housing;

permitting the lubricating fluid to flow in the pocket between the plurality of fluid chambers as the coupling tube moves along the housing to lubricate engaged mating threads between the coupling tube and the housing; and receiving a coring sample into the core cavity.

18. The method of claim 17, wherein the adjusting comprises moving the coupling tube along the housing via threads therebetween.

19. The method of claim 17, further comprising passing fluid into and out of the fluid chambers via ports in the housing.

20. The method of claim 17, wherein the adjusting is performed repeatedly without requiring removal of the fluid.

21. The method of claim 17, further comprising selectively diverting fluid flow about the coring assembly.

22. The method of claim 17, wherein the deploying comprises deploying the coring assembly via a downhole drilling tool, the method further comprising drilling the wellbore with the downhole drilling tool.

23. The method of claim 17, wherein the coring assembly includes a first seal that sealingly engages the coupling tube and the housing and a second seal that sealingly engages the coupling tube and the housing, wherein the pocket is axially positioned between the first seal and the second seal.

* * * * *